US005746144A

United States Patent [19]

Breen et al.

[11] Patent Number: 5,746,144

[45] Date of Patent: May 5, 1998

[54] METHOD AND APPARATUS FOR NOX REDUCTION BY UPPER FURNACE INJECTION OF COAL WATER SLURRY

[75] Inventors: Bernard P. Breen, Pittsburgh, Pa.; James E. Gabrielson, Hanover, Minn.; Joseph Cavello, New Kensington, Pa.

[73] Assignee: Duquesne Light Company, Pittsburgh, Pa.

[21] Appl. No.: 657,322

[22] Filed: Jun. 3, 1996

[51] Int. Cl.[6] ..... F23J 11/00

[52] U.S. Cl. ..... 110/345; 110/238; 110/245; 431/187; 431/284

[58] Field of Search ..... 110/215, 238, 110/263, 245, 345; 431/187, 284

[56] References Cited

U.S. PATENT DOCUMENTS

| | | | |
|---|---|---|---|
| 2,671,314 | 3/1954 | Lichty | 60/39.02 |
| 4,425,159 | 1/1984 | Nixon | 431/4 |
| 4,597,342 | 7/1986 | Green et al. | 110/347 |
| 4,726,192 | 2/1988 | Willis et al. | 60/737 |
| 4,779,545 | 10/1988 | Breen et al. | 110/212 |
| 4,785,746 | 11/1988 | Roy et al. | 110/347 |
| 4,790,743 | 12/1988 | Leikert et al. | 431/8 |
| 4,810,186 | 3/1989 | Rennert et al. | 431/175 |
| 5,078,064 | 1/1992 | Breen et al. | 110/212 |
| 5,141,726 | 8/1992 | Breen et al. | 423/235 |
| 5,181,475 | 1/1993 | Breen et al. | 110/345 |
| 5,544,598 | 8/1996 | Guibelin et al. | 110/238 |

FOREIGN PATENT DOCUMENTS 0 280 568 8/1988 European Pat. Off. .

OTHER PUBLICATIONS

"Enhancing the Use of Coals by Gas Reburning—Sorbent Injection," submitted at the Energy and Energy and Environmental Research Corporation (EERC), First Industry Panel Meeting, Pittsburgh, PA, Mar. 15, 1988.

"GR-SI Process design Studies for Hennapin Unit #1—Project Review," Energy and Environmental Research Corporation (EERC), submitted at the Project Review Meeting on Jun. 15–16, 1988.

"Reduction of Sulfur Triooxide and Nitrogen Oxides by Secondary Fuel Injection," Wendt, et al.; published at the Symposium of the Combustion Institute, 1972.

"Mitsubishi 'MACT' In-Furnace NOx Removal Process for Steam Generator", Sakai et al.; published at the U.S. Japan NOx Information Exchange, Tokyo, Japan, May 25–30, 1981.

"Application of Reburning for NOx Control to a Firetube Package Boiler", Mulholland et al., Journal of Engineering for Gas Turbines and Power, Jul. 1985, vol. 107, pp. 739–743.

"Gas Reburning and Gas Injection in Combination with SNCR in a Waste Incineration Plant", Karll, International Gas Reburn Technology Workshop, 7–9 Feb., 1995, Malmo.

"Optimization of Natural Gas Reburning for Controlling Pollutant Emissions from Oil Fired Boilers", E. C. Moller et al., 1988 Spring Meeting, Western State Section/The Combustion Institute, Salt Lake City, Utah, Mar. 21–22, 1988.

*Primary Examiner*—Henry A. Bennett
*Attorney, Agent, or Firm*—Buchanan Ingersoll

[57] ABSTRACT

In a method for reducing NOx in the flue gas a coal water slurry is injected into the furnace above the primary combustion zone into a region having a temperature from 1800° F. to 2700° F. The slurry is preferably injected through atomizers and through injectors that introduce a continuous stream. Lime, ammonia, urea and completion air can also be injected.

30 Claims, 3 Drawing Sheets

METHOD AND APPARATUS FOR NOX REDUCTION BY UPPER FURNACE INJECTION OF COAL WATER SLURRY

FIELD OF INVENTION

The invention relates to reducing $NO_x$ emissions from furnaces through the addition of fuel to the furnace above the primary combustion zone.

BACKGROUND OF THE INVENTION

During combustion of fuels with fixed nitrogen such as coal, oxygen from the air may combine with the nitrogen to produce nitrogen oxides ($NO_x$). At sufficiently high temperatures, oxygen reacts directly with atmospheric nitrogen to form $NO_x$. Emission of nitrogen oxide is regarded as undesirable because the presence of nitrogen oxide in a furnace flue gas (along with sulfur dioxides) causes the condensed gases to become corrosive and acidic. There are numerous government regulations which limit the amount of nitrogen oxide which may be emitted from a combustion furnace. Titles I and IV of the Clean Air Act as amended in 1990 ("the Clean Air Act") require significant $NO_x$ reduction from large power plants. Title I of the Clean Air Act focuses on the problem of ozone non-attainment. Ozone is formed as a result of photochemical reactions between nitrogen oxides emitted from central power generating stations, vehicles and other stationary sources, and volatile organic compounds. Ozone is harmful to human health. Consequently, in many urban areas the Title I $NO_x$ controls are more stringent than the Title IV limits. Thus, there is a need for apparatus and processes which reduce the nitrogen oxide emissions in furnace flue gas.

Commercially available techniques to reduce the nitrogen oxide emissions in a furnace flue gas are low $NO_x$ burners, selective non-catalytic $NO_x$ reduction (SNCR), selective catalytic reduction (SCR) and reburning. Currently, retrofitting boilers with low $NO_x$ burners is the most economic route to comply with Title IV requirements of the Clean Air Act. However, low $NO_x$ burners cannot reduce $NO_x$ emissions to levels required by Title I of the Clean Air Act. As a consequence electric utilities are faced with the option of adding SNCR or reburning to the boiler. In addition, cyclone boilers cannot be retrofitted with low $NO_x$ burners. SNCR and reburning are the two options for cyclone boilers.

The reburning process is also known as in-furnace nitrogen oxide reduction or fuel staging. The standard reburning process has been described in several patents and publications. See for example, "Enhancing the Use of Coals by Gas Reburning-Sorbent Injection," submitted at the Energy and Environmental Research Corporation (EERC), First Industry Panel Meeting, Pittsburgh, Pa., Mar. 15, 1988; "GR-SI Process Design Studies for Hennepin Unit #1—Project Review," Energy and Environmental Research Corporation (EERC), submitted at the Project Review Meeting on Jun. 15–16, 1988; "Reduction of Sulfur Trioxide and Nitrogen Oxides by Secondary Fuel Injection," Wendt, et al.; published at the Symposium of the Combustion Institute, 1972; "Mitsubishi 'MACT' In-Furnace NOx Removal Process for Steam Generator," Sakai, et al.; published at the U.S.-Japan NOx Information Exchange, Tokyo, Japan, May 25–30, 1981. In reburning a fraction of the total thermal input is injected above the primary flame zone in the form of a hydrocarbon fuel such as coal, oil, or gas. A reburn zone stoichiometry of 0.90 (10% excess fuel) is considered optimum for $NO_x$ control. Thus, the amount of reburn fuel required is a direct function of the primary zone excess air.

Under typical boiler conditions a reburn fuel input in the range 15% to 25% is sufficient to form a fuel-rich reburn zone. The reburn fuel is injected at high temperatures in order to promote reactions under the overall fuel rich stoichiometry. Typical flue gas temperatures at the injection location are above 2600° F. Completion air is added above the fuel rich reburn zone in order to burn off the unburnt hydrocarbons and carbon monoxide (CO). In addition to the above specifications the prior art on standard reburn teaches that rapid and complete dispersion of the reburn fuel in flue gas is beneficial. Thus, flue gas recirculation (FGR) has been used to promote mixing in all standard reburn demonstrations. Standard reburn technology requires a tall furnace to set up a fuel rich zone followed by a lean zone. Many furnaces do not have the volumes required for retrofitting this technology.

In current practice of the reburning process, usually more than enough fuel is added to react with all of the oxygen remaining in the original combustion products. A reducing zone, or a zone with an excess of fuel is formed. In this reducing zone the NO reacts with the excess fuel to form $N_2$, $NH_3$, HCN, and other reduced nitrogen. Then more air is added to combust the remainder of the reburn fuel. At this point the $NH_3$, HCN, and other reduced forms are oxidized to $N_2$ and NO. At this step and through out the mixing process there is also a direct reaction between NO and $NH_3$ to form $N_2$. In each step part of the fixed nitrogen (originally NO) was converted to $N_2$. This is the goal of the reburn process.

Sometimes $NO_x$ reduction process is used in which the upper furnace fuel is not added in sufficient qualities to consume all of the oxygen remaining in the gas after the initial combustion. In such a process it is necessary that large volumes become reducing while parallel volumes remain oxidizing. In the reducing volumes $N_2$, $NH_3$, and HCN are formed. Then the reducing and oxidizing gases mix together and the remainder of the fuel is consumed. At this point the reduced nitrogen species are oxidized to $N_2$ and NO. Again there is direct reduction to $N_2$ by the reaction between $NH_3$ and NO.

The process which is sometimes called controlled mixing/upper furnace fuel injection usually requires natural gas as the upper furnace fuel. Natural gas is expensive. Penetration and mixing is a great problem. Utility boiler furnaces have horizontal dimensions of 50 feet and greater. The carrier gas may be steam, air, or recycled combustion products. Often it is necessary to use a carrier gas to assure adequate penetration of the natural gas into the furnace. If the upper furnace natural gas is 5% of the fuel and the fuel is only 10% of the air flow, upper furnace injected natural gas is perhaps only 0.5% of the gas flow. The combustion products being quite hot may have a volume as high as 1000 times the upper furnace natural gas. The steam is expensive. The use of air or recycled combustion products requires expensive duct work. Often there is no place for the duct work. The boiler face is simply too crowded with necessary equipment to allow the duct work to be installed. Large penetrations through the furnace walls are needed and this requires bending water wall tubes. The flue gas needs to be returned from a remote part of the boiler. Fans are needed for flue gas and often for air. Because air has oxygen in it, use of air as the carrier gas requires more upper furnace fuel before the gas stream can be made reducing.

Some operators have tried coal as a reburn fuel. The burnout times for coal are longer than for natural gas. This requires that both the fuel and the burn out air be added sooner. As a result much of the reaction occurs at higher temperatures which results in more $NO_x$ emissions. The use of coal requires that there be additional pipes to carry primary air and pulverized fuel from the mills usually at ground level to the height where the reburn fuel is injected. It may even require an additional pulverizer.

While this is an effective method of reducing $NO_x$ emissions there is a clear need for an improvement which would burn an inexpensive fuel, not require a carrier gas, not need extensive duct work, and not require coal pipes nor new coal pulverizers.

SUMMARY OF THE INVENTION

We provide a method of reducing $NO_x$ by injecting a coal water slurry into the upper furnace. Preferably the slurry is injected into a region of the furnace which is 1800° F. to 2700° F.

We also prefer to add lime to the coal water slurry. The lime reacts with sulfur dioxide to form calcium sulfate and thus reduce sulfur dioxide emissions.

We further prefer to introduce our slurry into the furnace through a combination of atomizing nozzles and jets.

We also may add ammonia or urea to the coal water slurry as a selective reducing agent to reduce NO.

Other objects and advantages of the invention will become apparent from a description of certain present preferred embodiments described with reference to the Figures.

DESCRIPTION OF THE PREFERRED EMBODIMENTS

Coal or other fuel, usually a solid fuel is burned in a furnace or a boiler. Most often the coal is pulverized to about 60–80% through a 200 mesh screen. It is conveyed to the furnace in about 15%–25% of the combustion air. It then flows through burners that also introduce the balance of the combustion air, usually with an excess in air of 10–35%. The coal burns and releases heat, much of which may be absorbed into water flowing in tubes which form the enclosure of the furnace.

Coal usually contains about 1% fixed nitrogen. During the combustion process 15% to 35% of this nitrogen is converted to NO. In addition a very small fraction of the nitrogen in the combustion air is converted to NO. Our process is designed to convert much of this NO to the harmless $N_2$.

To reduce the NO we inject a slurry of coal in water into the furnace above the top row of burners. We design our process to allow the coal to react with the oxygen in the combustion products and to burn out almost completely. At the same time we introduce the coal so the nitrogen reactions will be at the lowest possible temperature which will allow the lowest emissions.

Figure 1:
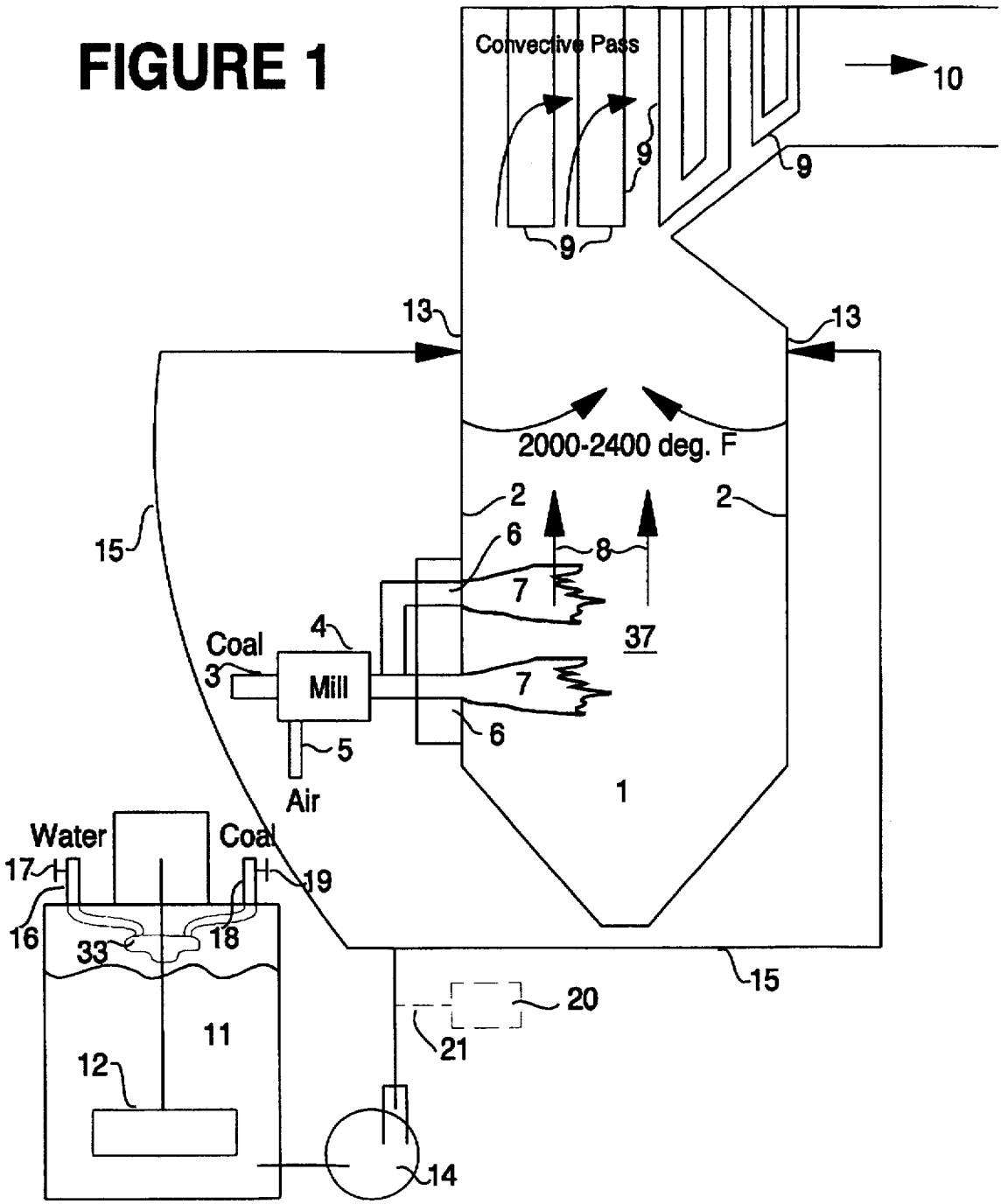
FIG. 1 is a diagram of a furnace in which a coal water slurry is being injected in accordance with the present invention.

Our coal water slurry can be injected into a wide variety of furnaces for $NO_x$ reduction. The furnace could be a boiler, a process heater, an incinerator, or a type of furnace which directly or indirectly supplies hot gases to heat materials in a process. The furnace 1 shown in FIG. 1 is designed to burn coal which passes from a supply pipe 3 into mill 4. The coal is milled and combined with air from primary air supply 5 and directed to burners 6. At the burners the coal is ignited forming flames 7 in the primary combustion zone 37. In the primary combustion zone the temperature typically is above 3,000° F. Combustion products flow from the primary combustion zone in the direction of arrows 8 to heat exchanges 9 in the upper convection zone of the furnace. The flue gas is then directed through conduct 10 to an economizer and other energy recovery devices and then to an exhaust stack (not shown). At some distance above the primary combustion zone there is region where the flue gas is in the range of 2,000° to 2,400° F. At that region we prefer to provide injectors 13 in the furnace wall 2. The lower the slurry is introduced, the more penetration will be possible and necessary. If the slurry is put in just before the convection pass, it will be necessary to have both good atomization and maximum penetration which are mutually exclusive. Lower injection or multiple elevation injection with some of the injection as jets is preferred. We provide a slurry tank 11 containing a mixer 12. Coal water slurry is drawn from the slurry tank by pump 14 through the slurry pipes 15 to injectors 13. Valves 17 and 19 on the water supply 16 and coal supply pipe 18 enable us to adjust the coal water ratio in the slurry. An optional supply 20 is connected to slurry pipe 15. Through this supply we can introduce lime, ammonia or urea into the coal water slurry.

The water in the slurry will reduce even further the combustion temperature which will improve the $NO_x$ removal. This water also improves the kinetics of the oxidation of CO which allows the process to operate at lower temperatures. The ratio of water to coal can be changed to further modify the very local temperature of the upper furnace combustion. If the temperature is a bit too high for the lowest $NO_x$ for $CaCO_3$ calcination, or for effective use of urea, more water can be added. Coal/water ratio changes can be made for final temperature trim and to adjust the location of the burn out of the coal in the slurry. An optional variable mixing chamber 33 shown in dotted line in FIG. 1 can be provided for controlling the coal/water ratio.

The upper furnace location of the injection and the cooling of the ensuing flames by the presence of the water provides a low temperature environment which is conducive to burning limestone to lime in a manner that causes the lime to be reactive. Limestone ($CaCO_3$) is sometimes injected directly into furnaces where it is calcined to lime (CaO) which subsequently reacts with the sulfur dioxide ($SO_2$) and oxygen in the gas to form calcium sulfate ($CaSO_4$) and thus the $SO_2$ emissions are reduced. Temperatures of 2000° to 2400° F. are needed to calcine limestone in the short time available in the furnace. Yet temperatures as low as 2600° F. can dead burn the lime. When the lime is dead burned it has less surface area and it only poorly reacts with the $SO_2$. Thus by adding limestone to our coal-water slurry where we control the reaction temperature we are able to effectively calcine the limestone without dead burning the resulting lime. Therefore, we produce a reactive product. This reactive lime is in the correct place to remove the $SO_2$ from the flue gas.

Figure 2:
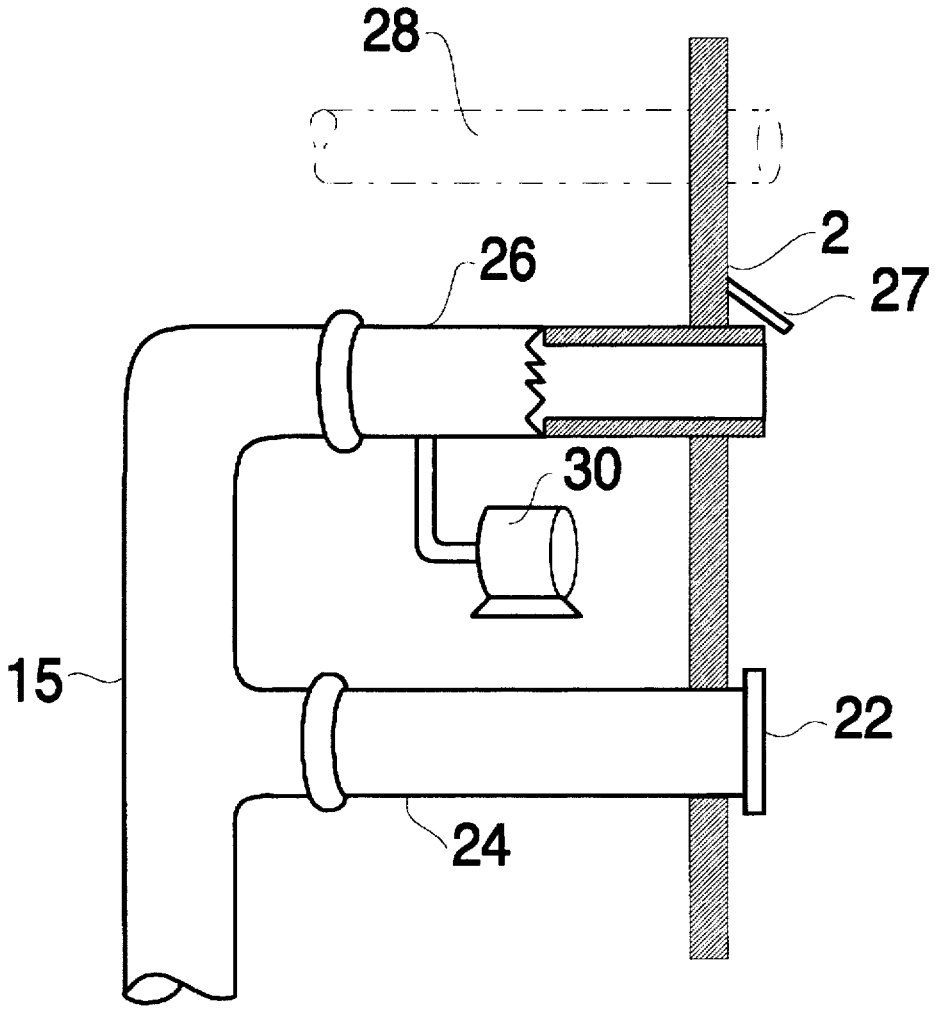
FIG. 2 is a side view partially in section of a present preferred injector combination for injecting the coal water slurry.

As shown in FIG. 2, we prefer to introduce the coal water slurry through atomizing nozzles 22 which can handle the slurry and are connected to injector pipe 24 and through open jets 26 which introduce a continuous stream for maximum penetration. Although only one atomizing nozzle and one jet are shown in FIG. 2, several such pairs are positioned around the furnace. Different size jets and atomized drops can be used depending upon the requirements of the specific furnace. A pump 30 connected to at least some of the injectors for injecting additional water, air or nitrogen into the slurry helps us to control the velocity of the slurry stream and resulting penetration. We wish to cover the total furnace area with coal water slurry in the cases where we use burn out air. If desired, completion air can be introduced near jets 22 and 26 through optional completion air pipe 28 shown in chainline in FIG. 2. An igniter 27 may also be provided at all or some of the jets or nozzles. In the case where no burn out air is used we wish to cover the volumes to be made reducing very completely without mixing any of the slurry into the part which is to remain oxidizing.

Figure 3:
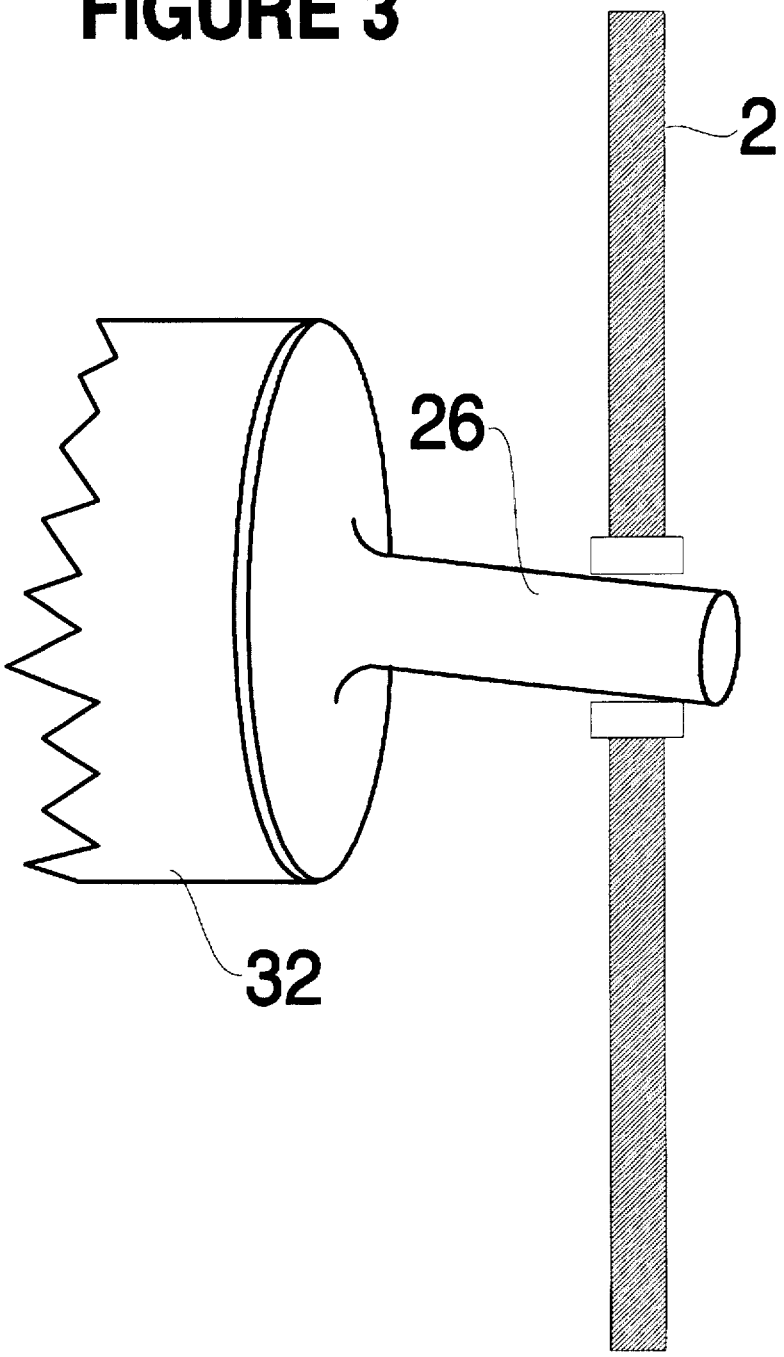
FIG. 3 is a side view of an adjustable injector for injecting the coal water slurry.

As shown in FIG. 3 we prefer to provide a coupling 32 for at least some of the injector pipes 24 and 26 which allows us to change the direction of flow of the slurry into the furnace. This permits the operator to adjust the injectors to assure that the entire area of the furnace receives the slurry.

In the case where no burn out air is used and a face fired or opposed fired unit is being used it is best to establish alternate lanes of reducing mixtures, by coal slurry injection, and oxidizing lanes. The relative width of the lanes would depend upon the amount of oxygen in the initial combustion products, the final amount of oxygen, and how much surplus fuel is to be in the reducing lanes. The absolute widths will be sufficient to allow almost complete volatilization and combustion of the coal in the reducing region.

In a tangentially fired boiler it is best to introduce streams of slurry one above the other in each corner of the furnace. Atomized streams may be introduced with the jets to assure complete coverage. The coverage zones are from 4 to 12 feet high. It is not always necessary to introduce the slurry at every corner. The same general arrangement of coal-water slurry injection would be used with and without completion air.

Cyclone furnaces can be treated in the furnace after the gas has exited the cyclones. A lane type arrangement is best unless completion air is used.

While the $NO_x$ which is removed from flue gas by reburn is often seen as the reduction of NO to $N_2$ by fuel or the reaction of $NH_3$ or HCN with $N_2$ by oxidation, some of the removal is the result of NO reacting with $NH_3$ or HCN to form $N_2$. The $NH_3$ or HCN usually is formed from NO by reduction by fuel. The reaction eliminates two fixed nitrogen atoms. This is very useful. Sometimes a reduced nitrogen will be added to react with NO. This is the case in the well know selective noncatalytic reduction of $NO_x$ (SNCR) where ammonia ($NH_3$) or urea is injected in the gas at about 1800° F. The reagent reacts with the NO to form $N_2$. In some cases, ammonia is added with natural gas to amplify the $NO_x$ reduction of a controlled mixing upper furnace fuel injection process.

We recognize that the coal has fixed nitrogen in it and that as the coal is combusted in the reducing eddies in the upper furnace some of the nitrogen liberated from the slurry coal will react with NO to form $N_2$. This will be more predominant if most of the upper furnace coal is burned with less than the stoichiometric air for complete combustion. The final burnout will be possible only if there is enough air for complete combustion. Since the total NO, both thermal $NO_x$ and fuel bound nitrogen $NO_x$ will be only 10% to 30% of the nitrogen in the primary fuel, a small amount of reburn coal could supply enough fixed nitrogen to eliminate most of the NO by this mechanism alone. However, this nitrogen is not very effective at reducing $NO_x$ at the temperatures in the upper furnace. These temperatures are too high for best use of $NH_3$ or urea to reduce NO.

To overcome this problem, some more reduced nitrogen can be added to the coal water slurry. Urea or ammonia can be added to the coal water slurry to act as a selective reducing agent to reduce NO. These nitrogen sources can be injected in amounts to provide fixed atoms of nitrogen in the range of 0.5 to 10 times as many atoms of nitrogen as $NO_x$ in the flue gas. The temperature is high enough that we need not worry about slip. The $NH_3$ or urea that does not react with the NO will be decomposed. At the same time, the reducing conditions will keep the decomposing $NH_3$ or urea from forming NO. Both urea and ammonia are readily soluble in water and can easily be added to the slurry and in amounts beyond the stoichiometric ratio with the NO. The excess will form $N_2$ in the reducing conditions at these temperatures, which are several hundred degrees above the optimum SNCR temperature.

The water in the slurry will increase the acid dew point of the flue gas and cause more $SO_3$ to condense on the fly ash as sulfuric acid. The result will be a better performing electrostatic precipitator. The water in the slurry, beside providing for penetration, also aids coal combustion through the well known coal-water gasification reaction.

In general it is better to operate upper furnace fuel injection at temperatures which are as low as possible. This increases the $NO_x$ reduction potential directly in proportion to the decrease in equilibrium $NO_x$ as the temperature decreases. However, in the case of coal water slurry where the fuel is very economical it is possible to overcome this temperature limitation by using upper furnace fuel. If completion air is used, it is necessary to use a great amount of completion air if a great amount of coal-water slurry is used as upper furnace fuel. If no completion air is used and a great amount of upper furnace slurry is used it is only necessary to assure that the lower furnace is sufficiently air rich to supply the oxygen for burn out.

Our fuel injection temperature window is much wider than reburn temperature windows where it is only economical to reburn with 2 to 12% of the total fuel. In our case, where the coal water slurry is at most little more expensive than the base fuel we can supply 3% to 35% of the total fuel as upper furnace injection fuel and do so at very high temperature while achieving large $NO_x$ reductions. In some cases the coal water slurry can be made from materials recovered from gob piles and may even be cheaper than the base coal.

Our temperature window is 1800° to 2700° F. The slurry is from 40% to 80% water and adjustments can be made to accommodate different furnaces or furnace conditions. The slurry is introduced both as streams (jet) and spray of drops, usually in combination to assure better coverage.

We do not require carrier air, steam, nor flue gas. We can design systems with and without burn out air. We do not require the elaborate duct work of other processes. We do not require the expensive natural gas. Our process when used with coal slurries recovered from gob piles will help to clean up the landscape.

Although we have described certain present preferred embodiments of our method and apparatus it should be distinctly understood that our invention is not limited thereto but may be variously embodied within the scope of the following claims.

We claim:

1. An apparatus for reducing nitrogen oxide emissions from a furnace wherein a fuel is burned in a primary combustion zone and produces a flue gas containing nitrogen oxide which comprises at least one injector attached to the furnace above the primary combustion zone and a source of a coal water slurry connected to the injector.

2. The apparatus of claim 1 wherein the injector is comprised of an atomizer which disperses a portion of the coal water slurry as a spray of drops and a jet adjacent the atomizer the jet is able to introduce a portion of the coal water slurry as a continuous stream.

3. The apparatus in claim 2 wherein some of the plurality of injectors are atomizers and some of the plurality of injectors introduce a continuous stream.

4. The apparatus of claim 1 wherein there are a plurality of injectors.

5. The apparatus of claim 1 wherein the injectors are located at an elevation where the average gas temperature in the furnace is between 1800° and 2700° F.

6. The apparatus of claim 1 wherein the injectors are capable of supplying 3 to 35% of the total fuel.

7. The apparatus of claim 1 also comprising an apparatus for supplying completion air connected to the furnace.

8. The apparatus in claim 1 wherein the injectors can be adjusted to direct the flow up or down and from side to side.

9. The apparatus in claim 1 wherein the mixing can be controlled by adjusting the atomization and the jet penetration.

10. The apparatus in claim 1 wherein the burn out of the coal particles can be controlled by adjusting the elevation where the injectors are functioning.

11. The apparatus in claim 1 also comprising completion air ports adjacent the injectors.

12. The apparatus in claim 1 also comprising at least one ignitor adjacent a distal end of at least one of the injectors.

13. The apparatus in claim 1 also comprising a variable mixing chamber wherein a ratio of coal to water in the slurry can be adjusted to trim reburn temperature.

14. An apparatus for reducing nitrogen oxide emissions from a furnace wherein fuel is burned in a primary combustion zone and produces a flue gas containing nitrogen oxide comprising:

a. at least one injector attached to the furnace above the primary combustion zone;

b. a source of a coal water slurry connected to the injector; and c. a limestone supply connected to the source of coal water slurry.

15. An apparatus for reducing nitrogen oxide emissions from a furnace wherein fuel is burned in a primary combustion zone and produces a flue gas containing nitrogen oxide comprising:

a. at least one injector attached to the furnace above the primary combustion zone;

b. a source of a coal water slurry connected to the injector; and c. a reduced fixed nitrogen supply device connected to the source of coal water slurry.

16. The apparatus in claim 15 wherein the reduced fixed nitrogen supply device contains one of ammonia and urea.

17. The apparatus in claim 15 wherein the reduced fixed nitrogen supply device contains a nitrogen source having fixed atoms of nitrogen in the range of 0.5 to 10 times as many atoms of nitrogen as $NO_x$ in the flue gas.

18. A method of reducing nitrogen oxides in flue gas comprising the step of injecting a slurry of coal and water into said flue gas so that the coal and water mixes with nitrogen oxides in the flue gas to promote a reaction between said nitrogen oxides in the flue gas and said coal, so as to reduce nitrogen oxide content of the flue gas and to maintain overall fuel lean conditions above a primary combustion zone.

19. The method of claim 18 wherein burnout air is injected with the slurry.

20. The method of claim 18 wherein slurry is injected into flue gas having a temperature in the range of 1800° to 2700° F.

21. The method of claim 18 also comprising introducing combustion air at a location of where the coal water slurry is injected.

22. The method of claim 18 also comprising changing a ratio of water to coal during injection of the slurry to change upper furnace combustion temperature.

23. A method of reducing nitrogen oxides in flue gas comprising adding limestone to a coal water slurry and injecting the slurry into the flue gas so that the coal and water mix with nitrogen oxides in the flue gas to promote a reaction between said nitrogen oxides in the flue gas and said coal, so as to reduce nitrogen oxide content of the flue gas and to maintain overall fuel lean conditions above a primary combustion zone.

24. The method of claim 23 wherein the slurry has a ratio of water to coal also comprising changing the ratio of water to coal in the coal water slurry and then injecting the slurry having a different ratio of water to coal into the flue gas.

25. The method of claim 23 wherein the limestone is added in a quantity to provide to 0.25 to 2.5 moles of limestone per mole of $SO_2$ in the flue gas.

26. A method of reducing nitrogen oxides in flue gas comprising:

a. adding a material containing reduced nitrogen to a coal water slurry;

b. injecting the slurry into the flue gas so that the coal and water mix with nitrogen oxides in the flue gas to promote a reaction between said nitrogen oxides in the flue gas and said coal, so as to reduce nitrogen oxide content of the flue gas and to maintain overall fuel lean conditions above a primary combustion zone; and c. introducing combustion air at a location where the slurry is injected.

27. The method of claim 26 wherein the reduced nitrogen is added in a quantity to provide 0.5 to 10 times atoms of nitrogen per atom of NO in the primary combustion products.

28. The method of claim 26 wherein the reduced nitrogen is ammonia.

29. The method of claim 26 wherein the reduced nitrogen is urea.

30. The method of claim 26 also comprising changing a ratio of water to coal to improve use of fixed nitrogen.

* * * * *